United States Patent [19]

Delfino et al.

[11] 4,450,230

[45] May 22, 1984

[54] PHOTOGRAPHIC ELEMENTS WITH IMPROVED SURFACE CHARACTERISTICS

[75] Inventors: Gerolamo Delfino, Savona; Simone Franco, Ferrania/Savona, both of Italy

[73] Assignee: Minnesota Mining and Manufacturing Company, St. Paul, Minn.

[21] Appl. No.: 434,969

[22] Filed: Oct. 18, 1982

[30] Foreign Application Priority Data

Oct. 23, 1981 [IT] Italy ..... 49559 A/81

[51] Int. Cl.[3] ..... G03C 1/78

[52] U.S. Cl. ..... 430/539; 430/523; 430/950; 430/961

[58] Field of Search ..... 430/539, 961, 273, 950, 430/523

[56] References Cited

U.S. PATENT DOCUMENTS 3,877,947 4/1975 Tsuji et al. ..... 430/961

4,013,472 3/1977 Horie et al. ..... 430/961

4,232,117 11/1980 Naoi et al. ..... 430/539

*Primary Examiner*—Jack P. Brammer

*Attorney, Agent, or Firm*—Donald M. Sell; James A. Smith; Mark A. Litman

[57] ABSTRACT

Photographic elements, comprising a support, at least a light-sensitive silver halide emulsion layer and an external non light-sensitive gelatin protective layer, have the surface delustered by the presence in the external protective layer of water-soluble vinyl polymers which contain, as pendant groups, methylolamide moieties.

Preferably said water-soluble vinyl polymers are polymethylolacrylamide and copolymers of methylolacrylamide and other unsaturated vinyl monomers, such as ethylacrylate, acrylamide, acrylic acid, ethylvinylether and butylvinylether, said copolymers containing at least 50% by weight of unities derived from the vinyl monomer containing the methylolamide moiety.

19 Claims, No Drawings

PHOTOGRAPHIC ELEMENTS WITH IMPROVED SURFACE CHARACTERISTICS

DESCRIPTION

The present invention relates to silver halide photographic elements with improved surface characteristics, particularly to photographic elements having a non-shiny or non-bright surface, and to a method for obtaining improved surface characterisitics in photographic elements during their manufacture.

Photographic elements consist of one or more gelatin layers containing silver halide emulsions coated on a support. After drying, the emulsion layer is very sensitive to physical abrasion and scratching, and developed silver impressions can form even by simple pressure exerted on the silver halide grains. This defect is reduced by the application of a thin protective gelatin layer coated on the outermost emulsion layer. This protective gelatin layer coated on said emulsion layer and dried causes an increase of the surface reflection of the element which, in its turn, renders the surface of the element shiny or bright, thus disturbing the reflection examination of the images (this defect being particularly serious in the case of sheet films for medical radiography).

Experiments, performed by the Applicant, have shown that the surface brightness defect is accentuated in the case of photographic elements coated in the most modern industrial plants which are characterized by high coating rates and high drying temperatures, and still more in the case of photographic elements of low silver content where the covering power of the developed silver is increased by providing the photographic emulsion with special polymeric materials known as "gelatin extenders", such as the acrylamide-acrylic ester copolymers described in Italian Pat. No. 761,724, and the low molecular weight dextran described in U.S. Pat. No. 3,063,383.

Now it has been found that water-soluble vinyl polymers containing, as pendant groups, methylolamide moieties, included into the outermost gelatin protective layer of a photographic element comprising one or more silver halide emulsion layers, associated or not with "gelatin extenders", causes a significant delustering or anti-brightening effect.

The present invention refers to a photographic element comprising a support, at least a light-sensitive silver halide emulsion layer and an external non light sensitive gelatin protective layer wherein said external protective layer comprises a water-soluble vinyl polymer which contains, as a pendant group, methylolamide moieties, said polymer being present in a quantity such as to render the surface less reflective or non-bright.

The present invention preferably refers to a water-soluble vinyl polymer having the following formula:

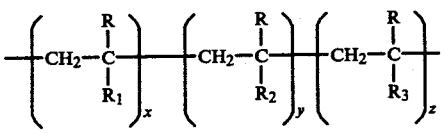

wherein:

R is independently selected from a hydrogen atom or a methyl group;

$R_1$ is the $—CONHCH_2OH$ group (i.e. the methylolamide moiety);

$R_2$ and $R_3$, equal or different, are one of the groups of formula $—COOH$, $—COOR^4$, $—COR_4$, $—CONH_2$, $—OCOR_4$, $—CONHR_4$, $—CON(R_4)_2$, $—CN$, $—C_6H_5$ and $—OR_4$, wherein $R_4$ is an alkyl group with 1 to 4 carbon atoms;

x indicates about 50 to 100 percent by weight of the polymer;

y and z indicate about 0 to 50 percent by weight of the polymer with the proviso that $y+z$ is $100-x$ percent by weight.

The present invention in particular refers to a photographic element as described above, wherein the polymer is polymethylolacrylamide. Still in particular, the present invention refers to a photographic element, wherein the polymer is a methylolacrylamide and ethylacrylate copolymer or a copolymer formed by methylolacrylamide and a polymerizable unsaturated monomer preferably selected among acrylamide, acrylic acid, ethylvinylether and butylvinylether. More in particular, the present invention refers to a photographic element, as hereintofore described, wherein the polymer has a molecular weight corresponding to an intrinsic viscosity in the range from 0.1 to 1.5 dl/g when determined in $NaNO_3$ 1 N at 30° C. Still more in particular, the present invention refers to a photographic element, as hereintofore described, wherein the polymer is present in the protective layer in a quantity ranging from 0.1 to 1 gram per square meter, and/or the ratio of said polymer with respect to the gelatin of the protective layer is in the range from 10 to 60 percent.

According to another aspect, the present invention refers to a photographic element, as hereintofore described, wherein said external protective layer in addition contains discrete particles of a matting agent, insoluble in water and in the photographic processing solutions, in combination with said polymer or copolymer.

According to a further aspect, the present invention refers to a process for making the surface of a photographic element less reflective or non-bright, where this element comprises a support, at least a silver halide gelatin emulsion layer and an external gelatin protective layer, said process consisting of mixing the solution of the external protective layer, prior to the coating thereof onto the emulsion layer, with a water solution of a vinyl polymer which contains, as pendant groups, methylolamide moieties, and then spreading the resulting composition on the emulsion layer.

The polymers containing methylolamide moieties, useful to the purposes of the present invention, can be prepared starting from vinyl monomers containing methylolamide moieties, such as methylolacrylamide, or starting from vinyl monomers containing amide groups, such as acrylamide and methacrylamide. In the former case, methylolacrylamide is homopolymerized or copolymerized with one or more unsaturated monomers according to techniques known in the art. The polymerization temperature does not generally exceed 100° C., and is more preferably comprised between 50° and 100° C. The polymerization can be performed in a solvent, e.g. methanol, ethanol and acetone. Polymerization catalysts can be used, such as for instance free-radical catalysts like benzoyl peroxide, cumene hydroperoxide, azo-initiators like azobisisobutyrronitrile, etc. In the latter case, an acrylamide or methacrylamide homopolymer or copolymer with one or more unsaturated monomers, prepared according to techniques known in the art, is reacted in alkaline water solution with a pH preferably of 12–13 with aqueous formaline at a moderate temperature, preferably ranging from 50° to 100° C., more preferably of about 70° C.

The unsaturated vinyl monomers, useful to the purposes of the present invention to obtain copolymers having the above described moiety, are those well-known in the art for their capability of copolymerizing with the acrylamide derivatives in general, e.g. alkyl acrylates and methacrylates, such as methyl acrylate, methyl methacrylate, ethylacrylate and butylacrylate, etc., acrylamide, methacrylamide and N-substituted acrylamides and methacrylamides, such as N-methylacrylamide, N-ethylacrylamide, N,N-dimethylacrylamide, N-morpholin-acrylamide, etc. Preferable to the purposes of the present invention proved to be acrylamide, acrylic acid, ethylvinyl ether and butylvinyl ether, more preferably ethyl acrylate.

The weight quantity of such monomers in the copolymers of the present invention is preferably such as not to exceed 50 percent, the remaining quantity being derived by the vinyl monomers containing the methylolamide moiety. Higher quantities in fact make the copolymer heavy with a part that is not active according to the present invention and which may cause problems when the copolymers are introduced into the photographic element or may decrease the water solubility and the compatibility thereof with the coating compositions if said monomers are insoluble in water.

The molecular weight of said polymers can be varied as much as one likes according to what known in the art, by properly selecting the polymerization conditions (e.g. time, temperature, concentration, etc.). To the purposes of the present invention, the molecular weight is preferably comprised in the range corresponding to intrinsic viscosities (measured in $NaNO_3N$ solution at 30° C.) comprised between 0.1 and 1.5 dl/g. Molecular weights corresponding to lower or higher viscosities than those preferred are thought to cause disadvantages during the employment of the polymers in the photographic element, e.g. migration to the adjacent layers, solubility in the processing baths, excessive increase of the viscosity of the coating composition where the polymers are introduced.

The experiments performed by the Applicant to the purposes of the present invention show in particular that the polymers containing the methylolamide moieties are generally incorporated by means of water solutions into the external protective layer of the photographic element in a quantity such as to reduce the reflecting power. In particular, said polymers are generally present in the protective layer in a quantity ranging from 0.10 to 1 gram, preferably from 0.25 to 0.80 gram per square meter in a ratio from 10 to 60 percent, preferably from 20 to 50 percent with respect to the gelatin of the protective layer itself, such layer having a thickness comprised between 0.5 and 2.0 micron, more preferably between 0.6 and 1.2 micron.

Said polymers have been found to be particularly suitable to improve the surface optical characteristics of the photographic element when it is examined after development: i.e. to reduce appreciably-without significant loss of transparency-the light reflected by the external surface at the air-protective layer interface, which causes dazzling in particular in higher density regions (such defect being particularly serious in the case of photographic elements for use in radiography, the images of which have to be observed for a long time and with attention to detail).

The photographic element surface made non-bright according to the present invention has proved superior to that obtained by other matting agents normally used in the art, for example silica and polymethylmethacrylate which, if used in a quantity as to make the surface less bright, give thereto a milky appearance which disturbes the viewing under transparency of the image formed therein. Lower quantities, e.g. up to 100 mg per square meter, preferably quantities between 5 and 80 mg per square meter, of these matting agents result however to be useful in combination with the polymers of the present invention, since they protrude out of the surface under the form of discrete particles thus controlling the mechanical characteristics of the photographic element, such as tendency for the film to become tacky, slipperiness, scratchability, or reducing the accumulation of electrostatic charges.

It has been found furthermore that the water soluble vinyl polymers containing, as pendant groups, methylolamide moieties of the present invention, used in a gelatin layer of a photographic element, reticulate the gelatin. They behave as gelatin hardeners and can partially or totally replace the hardeners normally used in the layers of the photographic materials. It is known in fact that gelatin containing layers, which have not been treated with hardeners, have a low resistance to water and swell excessively in water solutions so that their mechanical strength is highely reduced. Such swelled layers may dissolve in water solutions having a high temperature, e.g. above 30° C., or a strongly alkaline pH, e.g. above 10.5. The presence of hardeners result to be effective to prevent such high swelling and effects associated therewith. Many compounds are known as gelatin hardeners to be used in photographic materials, such as those described in T. H. James, *The Theory Of The Photographic Process*, 4th edition, McMillan, 1977, pages 77 to 87 and in Research Disclosure 17643, December 1978, paragraph X. When such hardeners are used in the photographic materials of the present invention, the hardening effect of the polymers containing the methylolamide moiety is of course to be taken into account. If used, such conventional hardeners have to be dosed in such a way that the resulting hardening, including that caused by the polymers of the present invention, does not become excessively high (otherwise, as well-known in the art, the developability of the photographic element should be jeopardized, i.e. an undesired contrast and maximum decrease could be caused).

The following examples report some experimental data gained by means of processes and measurements which are of normal use in the art. In particular, as regards brightness, it was measured with Multi Angle (20°/60°/85°) Digital Glossgard of Gardner Laboratory Inc. with an incidence angle of 60° (as known in the practice, such instrument gives values higher or equal to 60 for bright surfaces of photographic materials) and with a subjective evaluation by giving a mark from 4 (very bright surfaces) to 8 (very dull surfaces), intermediate values meaning intermediate situations. The hardness was measured with a particular instrument provided with a stylus which engraves the sample imbibed with a liquid composition, water or processing solution, where it has been kept for a given time at a given temperature. The hardness values are expressed in grams loaded on the stylus to engrave the sample: the higher the weight, the harder the material.

EXAMPLE 1

Preparation of methylolacrylamide ethylacrylate copolymer 400 g of an acrylamide-ethylacrylate 80-20 copolymer were dissolved in 1200 ml of water; the pH was adjusted to 12–13 by adding NaOH; 400 ml of 40% formalin were added while heating to 70° C. for 2 hours; the pH was kept at 12–13 with further addition of NaOH. After cooling the solution was poured into 15 liters of ethanol under good stirring, the separated polymer was filtered, washed with acetone and dried at reduced pressure. Yield: 590 g of water-soluble polymer. Analytical results: free $CH_2O$: absent; total $CH_2O$: 18.9%; [η]: 0.36 dl/g in $NaNO_3N$ at 30° C.

EXAMPLE 2

Preparation of polymethylolacrylamide 56 g of N-methylolacrylamide were dissolved in 1000 ml of ethanol, then added with 0.36 g of dibenzoylperoxide and heated to reflux for 6 hours while stirring under nitrogen atmosphere. After cooling, the reaction mixture was poured into acetone under good stirring. The polymer was filtered, washed and dried as usual. Yield: 53 g. Analytical results: [η]: 0.13 dl/g in $NaNO_3N$ at 30° C.

EXAMPLE 3

Preparation of methylolacrylamide-ethylacrylate copolymer 56 g of N-methylolacrylamide were dissolved in 1000 ml of ethanol, then added with 23 ml of ethylacrylate and 0.36 g of dibenzoylperoxide and heated to reflux for 6 hours while stirring under nitrogen atmosphere. After cooling the reaction mixture was poured into acetone under good stirring. The polymer was filtered, washed and dried as usual. Yield: 62 g. Analytical results: free $CH_2O$: absent; total $CH_2O$: 19.10%; [η]: 0.12 dl/g in $NaNO_3N$ at 30° C.

EXAMPLE 4

Preparation of methylolacrylamide-acrylamide-ethylacrylate terpolymer 36 g of recrystallized N-methylolacrylamide and 20 g of recrystallized acrylamide were dissolved in 1200 ml of acetone, then added with 23 ml of freshly dissolved ethylacrylate and 0.36 g of dibenzoylperoxide and heated to reflux for 6 hours while stirring under nitrogen atmosphere. After cooling the polymer was filtered, washed with acetone and dried as usual. Yield: 63 g. Analytical results: free $CH_2O$: absent; total $CH_2O$: 16.23%; [η]: 1.20 dl/g in $NaNO_3$ 1 N at 30° C.

EXAMPLE 5

Preparation of polymethylolacrylamide 1200 g of recrystallized acrylamide, dissolved in 19 liters of ethanol, were added with 6 g of dibenzoylperoxide and heated to reflux while stirring under nitrogen atmosphere. After cooling, the polyacrylamide was filtered, washed and dried as usual. Yield: 117 g.

100 g of the above described polyacrylamide were dissolved in 300 ml of water; the pH was adjusted at 12–13 with NaOH; 100 ml of 40% formalin were added thereto while heating to 70° C. for 2 hours; the pH was kept at 12–13 with further addition of NaOH. After cooling the solution was poured into ethanol under good stirring. The separated polymer was filtered, washed with acetone at reduced pressure. Yield: 140 g of water-soluble polymer. Analytical results: free $CH_2O$: absent; total $CH_2O$: 27.6%; N% 13.4; [η]: 0.22 in $NaNO_3N$ at 30° C.

EXAMPLE 6

Preparation of methylolacrylamide-ethylvinylether copolymer 150 g of recrystallized acrylamide and 150 ml of freshly distilled ethylvinylether were dissolved in 1500 ml of ethanol, then added with 2.5 g of dibenzoylperoxide and heated to reflux while stirring under nitrogen atmosphere. After cooling the copolymer was filtered, repeatedly washed with acetone and dried. Yield: 1.60 g. N%: 17.24; [η]: 0.31 dl/g in $NaNO_31N$ at 30° C.

75 g of the above described copolymer were dissolved in 225 ml of water; the pH was adjusted to 12–13 by addition of NaOH, 75 ml of 40% formalin were added while heating to 70° C. for 2 hours; the pH was kept at 12–13 with further addition of NaOH. After cooling, the separated polymer was washed, filtered and dried as above referred. Yield: 106 g. Analytical results: free $CH_2O$: absent; total $CH_2O$: 21.8; N%: 11.8; [η]: 0.53 dl/g in $NaNO_3N$ at 30° C.

EXAMPLE 7

Preparation of methylolacrylamide-buthylvinylether copolymer 150 g of recrystallized acrylamide and 150 ml of freshly distilled n-butyl-vinylether were dissolved in 1500 ml of ethanol, added with 2.5 g of dibenzoylperoxide and heated to reflux while stirring under nitrogen atmosphere. After cooling the copolymer was filtered, washed repeatedly with acetone and dried. Yield: 147 g. N%: 16.49; [η]: 0.28 dl/g in $NaNO_3$ 1 N at 30° C.

75 g of the above described copolymer were dissolved in 225 ml of water; the pH was adjusted to 12–13 by adding NaOH; 76 ml of 40% formalin were added while heating to 70° C. for 2 hours; the pH was kept at 12–13 with further addition of NaOH. After cooling the solution was poured into ether under good stirring; the separated polymer was filtered, washed with acetone and dried at reduced pressure. Yield: 81 g of water-soluble polymer. Analytical results: free $CH_2O$: absent; total $CH_2O$: 23.7; N%: 12.7; [η]: 0.51 dl/g in $NaNO_3$ 1 N at 30° C.

EXAMPLE 8

A photographic film (Film A) was prepared by coating a gelatin silver bromo-iodide emulsion, physically ripened, chemically sensitized and added with the normal coating additions (such as antifoggants, stabilizers, optical sensitizers, plasticizers, coating surfactants) on the subbed surface of a polyester base to obtain a covering of 2.9 g/m$^2$ of silver and 2.17 g/m$^2$ of gelatin hardened with 0.22 g of dimethylolurea (DMU) and 0.11 g of resorcinaldehyde (RA) per 100 g of gelatin. Such layer was then coated with a layer of 1.07 g/m$^2$ of gelatin added with the normal coating additions and containing 0.06 g/m$^2$ of polymethylmethacrylate dispersed particles having a mean size of 3–4μ and hardened with 0.6 g of DMU and 0.3 g of RA per 100 g of gelatin.

A second film (Film B) was obtained similarly to the first, with the exception that the emulsion contained 40,000 molecular weight dextran in a quantity of 33 g per 100 g of gelatin and had been hardened with 0.31 g of DMU and 0.155 g of RA per 100 g of gelatin.

A third film (Film C) was obtained similarly to the second, with the exception that the emulsion layer had been hardened with 0.155 g of DMU and 0.075 g of RA per 100 g of gelatin and the protective layer contained 43 g of the polymer of Example 1 per 100 g of gelatin and had been hardened with 0.2 g of DMU and 0.1 g of RA per 100 g of gelatin.

After storage for 15 hours at 50° C., samples of the three films were processed for 90 seconds in a 3 M XP507 automatic processor in 3 M $XAD_2$ processing baths. The surface brightness of the processed films was evaluated with the subjective method as hereintofore described. The results are reported in Table 1.

TABLE 1

| Film | Brightness |
|---|---|
| A | 6 |
| B | 4.5 |
| C | 6.5 |

EXAMPLE 9

Six photographic elements (from A to F) were prepared as described in the preceding Example 8, all having 33 g of 40,000 molecular weight dextran per 100 g of gelatin, a covering of 2.9 g/m² of silver and 2.17 g/m² of gelatin in the emulsion layer, and 1.07 g/m² of gelatin and 0.06 g/m² of polymethylmethacrylate in the protective layer. All remaining substances further present in the two above mentioned layers are listed in the following table.

TABLE 2

| | Emulsion layer | Protective layer | |
|---|---|---|---|
| Film | DMU + RA g (per 100 g gel.) | DMU + RA g (per 100 g gel.) | Polymer of ex. 1 (per 100 g gel.) |
| A | 0.31 + 0.155 | 0.60 + 0.30 | — |
| B | 0.31 + 0.155 | 0.60 + 0.30 | 43 |
| C | 0.155 + 0.075 | — | 43 |
| D | — | — | 43 |
| E | 0.155 + 0.075 | 0.2 + 0.1 | 43 |
| F | — | 0.2 + 0.1 | 43 |

After storage for 15 hours at 50° C., the hardness of samples of each film was measured after having dipped the samples themselves for 5 minutes into water at 20° C. The results are reported in the following table.

TABLE 3

| Film | Hardness |
|---|---|
| A | 66 |
| B | 170 |
| C | 67 |
| D | 52 |
| E | 70 |
| F | 61 |

EXAMPLE 10

A photographic film (Film A) was prepared by coating a gelatin silver bromo-iodide emulsion, physically ripened, chemically sensitized and added with the normal coating additions and containing 40,000 molecular weight dextran in a quantity of 33 g per 100 g of gelatin, on the subbed surface of a polyester support to obtain a coverage of 2.5 g/m² of silver and 1.87 g/m² of gelatin hardened with 0.39 g of DMU and 0.125 g of RA per 100 g of gelatin. This layer was then coated with a layer of 1.07 g/m² of gelatin added with the normal coating additions, hardened with 0.60 g of DMU and 0.308 g of RA per 100 g of gelatin and containing 0.06 g/m² of polymethylmethacrylate dispersed particles of mean size of 3–4μ.

A second film (Film B) was obtained similarly, but with the variation that the emulsion layer had been hardened with 0.30 g of DMU and 0.15 g of RA per 100 g of gelatin and the protective layer contained 25 g of the polymer of Example 1 per 100 g of gelatin.

A third film (Film C) was obtained similarly to film B, but with the variation that the protective layer contained 43 g of the polymer of Example 1 per 100 g of gelatin.

Samples of the three films were storaged and processed as described in the preceding examples; the surface brightness was evaluated both according to the subjective method and with a Glossmeter Gardner as hereintofore described. The results are reported in the following table.

TABLE 4

| | Brightness | |
|---|---|---|
| Film | Glossmeter | Mark |
| A | 66 | 4 |
| B | 55 | 5.5 |
| C | 48 | 6.5 |

EXAMPLE 11

Five photographic films (from A to E) were prepared as described in Example 9, all having 33 g of 40,000 molecular weight daxtran per 100 g of gelatin, a coverage of 2.5 g/m² of silver and 1.87 g/m² of gelatin in the emulsion layer and 1.07 g/m² of gelatin and 0.06 g/m² of polymethylmethacrylate dispersed particles in the protective layer, the remaining substances being the following as reported in the following table:

TABLE 5

| | Emulsion layer | Protective layer | | |
|---|---|---|---|---|
| Film | DMU + RA g (per 100 g gel.) | DMU + RA g (per 100 g gel.) | Polymer, g (per 100 g gel.) | |
| A | 0.30 + 0.15 | 0.60 + 0.30 | Ex. 1 | 25 |
| B | 0.30 + 0.15 | 0.60 + 0.30 | Ex. 1 (*) | 25 |
| C | 0.30 + 0.15 | 0.60 + 0.30 | Ex. 6 | 25 |
| D | 0.30 + 0.15 | 0.60 + 0.30 | Ex. 5 | 25 |
| E | 0.39 + 0.195 | 0.60 + 0.30 | — | — |

(*) Polymer obtained by repeating the preparation of Example 1.

After storage for 15 hours at 50° C., the hardness and brightness were evaluated. The values are reported in the following table.

TABLE 6

| | | Brightness | |
|---|---|---|---|
| Film | Hardness | Glossmeter | Mark |
| A | 81 | 54 | 5.5 |
| B | 74 | 52 | 5.5 |
| C | 108 | 56 | 5.5 |
| D | 96 | 40 | 6.5 |
| E | 73 | 70 | 4 |

EXAMPLE 12

Five films (from A to E) were obtained similarly as described in Example 10. The following two tables report the variable data of the composition of the five films and the hardness and brightness values.

TABLE 7

| | Emulsion layer | Protective layer | | |
|---|---|---|---|---|
| Film | DMU + RA g (per 100 g gel.) | DMU + RA g (per 100 g gel.) | Polymer, g (per 100 g gel.) | |
| A | 0.30 + 0.15 | 0.60 + 0.30 | Ex. 1 | 25 |
| B | 0.30 + 0.15 | 0.60 + 0.30 | Ex. 4 | 25 |
| C | 0.30 + 0.15 | 0.60 + 0.30 | Ex. 3 | 25 |
| D | 0.30 + 0.15 | 0.60 + 0.30 | Ex. 2 | 25 |
| E | 0.39 + 0.195 | 0.60 + 0.30 | — | — |

TABLE 8

| | | Brightness | |
|---|---|---|---|
| Film | Hardness | Glossmeter | Mark |
| A | 67 | 53 | 5.5 |
| B | 69 | 54 | 5.5 |
| C | 47 | 56 | 5.5 |
| D | 48 | 58 | 5 |
| E | 53 | 72 | 4 |

The invention is not limited to the particular emulsions of the preceding examples, in that other emulsions can be similarly used as simple or mixed emulsions of silver chloride, silver bromo-iodide and silver chloro-bromo-iodide, both of fine and coarse grain, and prepared by various methods as described in Research Disclosure 18341, August 1979, paragraphs 1A and 1B. The emulsions can be chemically sensitized during or before chemical curing by adding sensitizing agents as described in Research Disclosure 18341, August 1979, paragraph 1C. The emulsions can contain stabilizing, antifog, development modification and anti-staining agents, agents which increase covering power, hardeners and anti-creasing agents as described in Research Disclosure 18341, August 1979, paragraphs II and II A–K. The emulsions can be spectrally sensitized, for example, in the wavelength region of the light emitted by reinforcing screens in the case of elements used in radiography, as described in Research Disclosure 18341, August 1979, paragraphs IX and X. In addition, besides gelatin and its partial or total substituent, the protective layer can comprise dyes, plasticizers, antistatic agents and development accelerators, etc., as described in Research Disclosure 18341, August 1979, paragraph IV. The emulsion is preferably spread over a polyester support as described in Research Disclosure 18341, August 1979, paragraph XII, but other supports, for example cellulose derivatives (cellulose, nitrate, cellulose triacetate, cellulose propionate, cellulose acetate propionate, etc.), polyvinylchloride, polystyrene, polycarbonates, glass, paper, etc. can be used. The photographic element according to the present invention can in addition comprise antistatic agents and layers as described in Research Disclosure 18341, August 1979, paragraph III. The invention has been described in particular for black and white photographic elements, e.g. for radiographic use. It is however not limited to said elements, and can also be used for color photographic elements comprising a plurality of silver halide emulsion layers sensitized towards different regions of the visible spectrum and containing color formers, called couplers, capable of forming dyes by chromogenic development of the exposed element with paraphenylene diamine developers.

As regards the composition of the polymer including the groups $R_1$, $R_2$ and $R_3$ in respective quantities x, y and z, as described above, it is essential that the group $R_1$ be present in a quantity (x) significant to the purposes of the present invention, preferably in a quantity of at least about 50 percent.

The nature and the relative quantities of the groups $R_2$ and $R_3$ are less critical to the purposes of the present invention. These groups must be of such nature as not to have phisically or chemico-photographically harmful effects on the materials in which they are introduced and are to be introduced in such quantities as to monitor the polymer activity, as regards both anti-brightening and hardening and also other effects, such as solubility and migration of the polymer itself, following criteria known to the skilled in the art.

To have $R_3$ different from $R_2$ has been found not to give any particular advantage in the above said monitoring effect, except some particular cases which the man skilled in the art will be able to evaluate from time to time. From the point of view of the compound preparation and employment, the choice of a copolymer rather than a terpolymer results to be easier.

We claim:

1. Photographic element comprising a support and a plurality of gelatin layers which comprise at least a silver halide emulsion layer and an external gelatin protective layer, characterized in that said external protective layer comprises, in a proportion of 10 to 60% by weight of the gelatin in said protective layer, a water-soluble vinyl polymer containing methylolamide moieties as pendant groups on 50 to 100 weight percent of ethylenic groups in said vinyl polymer in a quantity sufficient to reduce brightness.

2. Photographic element according to claim 1, wherein the polymer has the following formula:

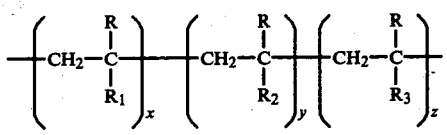

wherein:

R is independently selected from a hydrogen atom or a methyl group;

$R_1$ represents a $—CONHCH_2OH$ group;

$R_2$ and $R_3$, equal or different, represent a —COOH, $—COOR_4$, $—COR_4$, $—CONH_2$, $—CONHR_4$, $—CON(R_4)_2$, $—OCOR_4$, —CN, $—C_6H_5$ or a $—OR_4$ group, wherein $R_4$ represents an alkyl group with 1 to 4 carbon atoms;

x represents about 50 to 100 percent by weight of the polymer; and y and z each represent about 0 to 50 percent by weight of the polymer with the proviso that y+z is 100−x percent by weight of the polymer.

3. Photographic element according to claim 1, wherein the polymer is polymethylolacrylamide.

4. Photographic element according to claim 1, wherein the polymer is methylolacrylamide and ethylacrylate copolymer.

5. Photographic element according to claim 1, wherein the polymer is a copolymer derived from methylolacrylamide and an unsaturated polymerizable monomer selected in the group consisting of acrylamide, acrylic acid, ethylvinylether and butylvinylether.

6. Photographic element according to claim 2, 3, 4 or 5, wherein the polymer has a molecular weight corresponding to an intrinsic viscosity comprises in the range from 0.1 to 1.5.

7. Photographic element according to claim 2, 3, 4 or 5, wherein said polymer is present in the protective layer in a quantity ranging from 0.1 to 1 gram per square meter.

8. Photographic element according to claim 2, 3, 4 or 5, wherein said polymer is comprised in the protective layer in the presence of agents which increase the covering power of silver in said emulsion layer.

9. Photographic element according to claim 1 or 2, wherein said external protective layer in addition contains discrete particles of a matting agent insoluble in water and in the photographic processing solutions in combination with said polymer.

10. Photographic element according to claim 1, wherein the polymer has a molecular weight corresponding to an intrinsic viscosity comprised in the range from 0.1 to 1.5

11. Photographic element according to claim 3, wherein the polymer has a molecular weight corresponding to an intrinsic viscosity comprised in the range from 0.1 to 1.5.

12. Photographic element according to claim 4, wherein the polymer has a molecular weight corresponding to an intrinsic viscosity comprised in the range from 0.1 to 1.5.

13. Photographic element according to claim 5, wherein the polymer has a molecular weight corresponding to an intrinsic viscosity comprised in the range from 0.1 to 1.5.

14. Photographic element according to claim 1, wherein said polymer is present in the protective layer in a quantity ranging from 0.1 to 1 gram per square meter.

15. Photographic element according to claim 2, wherein said polymer is present in the protective layer in a quantity ranging from 0.1 to 1 gram per square meter.

16. Photographic element according to claim 1, wherein the ratio of said polymer with respect to the gelatin of the protective layer ranges from 10 to 60 per 100 g of gelatin.

17. Photographic element according to claim 2, wherein the ratio of said polymer with respect to the gelatin of the protective layer ranges from 10 to 60 per 100 g of gelatin.

18. Photographic element according to claim 5, wherein the ratio of said polymer with respect to the gelatin of the protective layer ranges from 10 to 60 per 100 g of gelatin.

19. Process to make the surface of a photographic element non-bright, wherein the element comprises a support and a plurality of gelatin layers which comprise at least a silver halide emulsion layer and an external protective layer, characterized in that the gelatin coating composition of the external protective layer is mixed with 10 to 60% by weight of the gelatin of a water solution of a vinyl polymer which contains, as pendant groups on 50 to 100 weight percent of ethylenic groups in said vinyl polymer, methylolamide moieties, before being coated onto said emulsion layer and the resulting composition is coated onto said emulsion layer.

* * * * *